US007661233B2

(12) United States Patent
Stenvall

(10) Patent No.: US 7,661,233 B2
(45) Date of Patent: Feb. 16, 2010

(54) INSULATING GLASS FASTENER

(75) Inventor: Bo Stenvall, Sävedalen (SE)

(73) Assignee: Vida International AB, Gothenburg (SE)

( * ) Notice: Subject to any disclaimer, the term of this patent is extended or adjusted under 35 U.S.C. 154(b) by 288 days.

(21) Appl. No.: 10/522,746

(22) PCT Filed: Jul. 10, 2003

(86) PCT No.: PCT/SE03/01199

§ 371 (c)(1),
(2), (4) Date: Jan. 26, 2006

(87) PCT Pub. No.: WO2004/011739

PCT Pub. Date: Feb. 5, 2004

(65) Prior Publication Data

US 2006/0123722 A1 Jun. 15, 2006

(30) Foreign Application Priority Data

Jul. 29, 2002 (SE) ..... 0202329

(51) Int. Cl.
*E04C 3/00* (2006.01)
*E06B 3/964* (2006.01)

(52) U.S. Cl. ..... 52/466; 52/235; 52/204.64; 292/95

(58) Field of Classification Search ..... 52/235, 52/127.7, 127.8, 127.9, 204.69, 204.7, 733.4, 52/466, 204.66, 204.63, 204.64; 403/252–255, 403/264, 331, 381; 292/95, 101, 107, 108, 292/DIG. 38, 241
See application file for complete search history.

(56) References Cited

U.S. PATENT DOCUMENTS

| | | | | |
|---|---|---|---|---|
| 49,535 | A * | 8/1865 | Knight et al. | 292/107 |
| 68,884 | A * | 9/1867 | Johnson et al. | 52/466 |
| 91,369 | A * | 6/1869 | Sargent | 292/95 |
| 425,330 | A * | 4/1890 | Langson | 292/95 |
| 891,852 | A * | 6/1908 | Muirhead | 292/109 |
| 1,036,013 | A * | 8/1912 | Scott | 292/95 |

(Continued)

FOREIGN PATENT DOCUMENTS

DE 197 55 697 A1 6/1999

(Continued)

*Primary Examiner*—Richard E Chilcot, Jr.
*Assistant Examiner*—Brent W Herring
(74) *Attorney, Agent, or Firm*—Harness, Dickey & Pierce, PLC

(57) ABSTRACT

A device (1) in glass wall claddings for mounting insulating-glass sheets (12), each glass sheet (12) comprising at least two glass slabs (13, 14), which are joined together by means of a jointing substance (16), said device (1) having a first position, wherein said device (1), upon mounting of said insulating-glass sheet (12), allows the insulating-glass sheet to be placed in the desired position, and a second position, wherein the device (1) grips at least one (13) glass slab of said insulating-glass sheet (12). The device (1) comprises a retainer member (3) and an anchoring member (2). A portion of one part (4) of the anchoring member (2), which part upon mounting of an insulating-glass sheet (12), i.e. as the anchoring member (2) of the device is guided from said first position to said second position, is arranged to penetrate into said jointing substance (16) of an insulating-glass sheet (12) in response to the anchoring member (2) being tilted to said second position.

17 Claims, 4 Drawing Sheets

U.S. PATENT DOCUMENTS

| | | | | | |
|---|---|---|---|---|---|
| 1,513,234 | A | * | 10/1924 | Fritsch | 292/101 |
| 1,620,414 | A | * | 3/1927 | Vanderlip | 292/101 |
| 1,639,072 | A | * | 8/1927 | Betz | 52/461 |
| 1,756,302 | A | * | 4/1930 | Pendery | 52/775 |
| 1,893,480 | A | * | 1/1933 | Mitchell | 52/466 |
| 2,034,331 | A | * | 3/1936 | De Vilbiss | 292/95 |
| 2,043,007 | A | * | 6/1936 | Place | 24/296 |
| 2,084,544 | A | * | 6/1937 | Wilson | 52/466 |
| 2,340,864 | A | * | 2/1944 | Miles | 52/127.9 |
| 3,296,763 | A | * | 1/1967 | Curl | 52/204.64 |
| 3,306,644 | A | * | 2/1967 | Larsen | 292/241 |
| 3,439,463 | A | * | 4/1969 | Matarese | 52/287.1 |
| 3,712,013 | A | * | 1/1973 | Kalus | 52/582.2 |
| 4,552,790 | A | * | 11/1985 | Francis | 428/34 |
| 4,625,477 | A | * | 12/1986 | Johnstonbaugh | 52/127.9 |
| 4,766,709 | A | * | 8/1988 | Galbraith | 52/235 |
| 4,777,777 | A | * | 10/1988 | Massimo | 52/586.2 |
| 4,912,898 | A | * | 4/1990 | Holmes | 52/235 |
| 5,161,268 | A | * | 11/1992 | Harrow | 5/201 |
| 5,199,236 | A | * | 4/1993 | Allen | 52/235 |
| 5,245,808 | A | * | 9/1993 | Grunewald et al. | 52/235 |
| 5,493,831 | A | * | 2/1996 | Jansson | 52/235 |
| 5,655,346 | A | * | 8/1997 | Holmes et al. | 52/476 |
| 5,768,837 | A | * | 6/1998 | Sjoholm | 52/204.62 |
| 5,802,799 | A | * | 9/1998 | Thuleskar et al. | 52/656.5 |
| 6,041,563 | A | * | 3/2000 | Vollers | 52/281 |
| 6,079,754 | A | * | 6/2000 | Alexy | 292/101 |
| 6,438,913 | B1 | * | 8/2002 | Ishikawa et al. | 52/235 |
| 6,832,457 | B2 | * | 12/2004 | Geiger | 52/656.5 |

FOREIGN PATENT DOCUMENTS

| | | |
|---|---|---|
| SE | 514 175 C2 | 1/2001 |
| WO | WO 02/02898 A1 | 1/2002 |

* cited by examiner

INSULATING GLASS FASTENER

TECHNICAL FIELD OF THE INVENTION

The present invention relates to a device in glass wall claddings for mounting insulating-glass sheets, each glass sheet comprising at least two glass slabs, which are joined together by means of a jointing substance, said device having a first position, wherein said device, upon mounting of said insulating-glass sheet, allows the insulating-glass sheet to be placed in the desired position, and a second position, wherein the device grips at least one glass slab of said insulating-glass sheet, said device comprising a retainer member and an anchoring member.

BACKGROUND OF THE INVENTION

Several designs of devices of the above-defined kind are previously known. In GB 2305205 is described a device for attachment of insulating-glass sheets. In this case, the insulating-glass sheets are subjected to a preparatory step involving positioning of members in the jointing substance between the glass sheets in predetermined places around the insulating-glass slab. Means having a configuration complementary to said members are moved into said members as the insulating-glass slab is locked (in position?). A drawback inherent in this device is that it requires preparation of the insulating-glass sheets, a feature that in addition offers less freedom as regards the positioning of the device on the insulating-glass sheet.

Also U.S. Pat. No. 5,802,799 describes a device conceived to fasten insulating-glass sheets that require a preparatory step, however without any members being provided in the jointing substance between the glass slabs. Instead, recesses are made in the jointing substance in certain predetermined places around the insulating-glass slab. In this case the device comprises means that may be slid for reception in said recesses as the insulating-glass slab is to be fixed. Consequently, this device too, enjoys less freedom as regards its positioning.

A further variety of devices for attachment of insulating-glass sheets is described in SE 514175, wherein the step of preparing the insulating-glass sheet has been eliminated. A rectangular washer, which is connected to a retainer element and which has a width equaling that of the spacing between two juxtaposed insulating-glass sheets and a length exceeding the width, is introduced between two insulating-glass sheets. The washer is then turned over approximately 90°, causing the short sides of the washer to penetrate into the jointing substance between the glass slabs and in this manner securing the insulating-glass sheet. Because the width of the rectangular element is limited by the spacing between two insulating-glass sheets, a large number of washers per unit length of insulating-glass sheet edge is required in order to obtain satisfactory attachment. In addition, it is necessary that two insulating-glass sheets, positioned adjacent one another, be secured simultaneously, which means that two insulating-glass sheets must be held in position simultaneously. As a result, the mounting of the insulating-glass sheets becomes more difficult.

SUMMARY OF THE INVENTION

The object of the invention is to eliminate the above-defined problems by providing an improved device for fastening insulating-glass sheets.

This object is achieved in according with the invention by imparting to the device of the kind defined in the introduction the characteristic features appearing from the appended claim 1. Preferred embodiments of the device are defined in the dependent claims.

In the inventive device for mounting insulating-glass sheets each glass sheet comprises at least two glass slabs, which are joined together by means of a jointing substance, said device having a first position, wherein said device, upon mounting of said insulating-glass sheet, allows the insulating-glass sheet to be placed in the desired position, and a second position, wherein the device grips at least one glass slab of said insulating-glass sheet. The device further comprises a retainer member and an anchoring member, and a portion of one part of the anchoring member, which part upon mounting of an insulating-glass sheet, i.e. as the anchoring member of the device is guided from said first position to said second position, is arranged to penetrate into said jointing substance of an insulating-glass sheet in response to the anchoring member being tilted to said second position. By means of the inventive device it thus becomes possible to fasten one insulating-glass sheet at a time, which facilitates the mounting operation considerably. At the same time there is no need to prepare the insulating-glass pane in the places, where the device is intended to grip the insulating-glass pane, because said anchoring-member part displaces the jointing substance sandwiched between the glass slabs of the insulating-glass sheet. A further consequence of this arrangement is that the device may be located in any optional places along the insulating-glass sheet edges and in any desired number.

Preferably, the device in accordance with the present invention is locked in said second position in order to ensure that the device does not disengage, i.e. returns to said first position.

In addition, the length along the insulating-glass sheet edge of that anchoring member part that penetrates into said jointing substance sandwiched between the glass slabs exceeds the spacing between two juxtaposed insulating-glass sheets in order to allow reduction of the number of devices and consequently of the mounting time. Alternatively, said part of the anchoring member may be serrated, i.e. it is not one single long and sharp edge that penetrates into the jointing substance.

In accordance with another aspect of the invention the retainer member is formed with an undercut groove, in which the anchoring member is hingedly received. Preferably, the anchoring member is divided into two parts, one of which, in use, is arranged in the groove in the retainer member and which is connected to a second part located externally of the retainer-member groove. Owing to this arrangement it becomes possible to lock the device in said second position by application, with the aid of a means, of a force urging the first and the second parts of the anchoring member towards one another and towards the groove opening.

In accordance with a further aspect of the invention, the anchoring member is formed with protruding and spring-biased means, which, upon movement of said anchoring member from said first position to said second position, fit in said second position into recesses of complementary configuration formed on the retainer member. In this manner, the anchoring member is locked in said second position by snap action. This arrangement reduced the mounting time further. Thus, the anchoring member need only be tilted sufficiently far for the device to securely lock the insulating-glass sheet in position.

The side of the anchoring member that is tilted towards the insulating-glass sheet as the anchoring member is displaced from the first position to the second position preferably is provided with a resilient portion. This resilient portion, such as a rubber moulding, prevents the glass slab or glass slabs (depending on whether the insulating-glass sheet comprises two or three glass slabs and in the case of three slabs whether the anchoring member grips one or two glass slabs) from cracking when exposed to the pressure exerted by the anchoring member, the latter conventionally being manufacture from metal of some kind.

Additional resilient portions preferably are provided on the retainer member on either side of its hinge connection to the anchoring member. The purpose of these resilient portions is to present a soft surface of engagement to the inwardly-turned glass surface of the inner glass slabs of two juxtaposed insulating-glass sheets.

BRIEF DESCRIPTION OF THE DRAWINGS

The invention will be described in the following in more detail by means of one embodiment with reference to the accompanying drawings. In the drawings.

DETAILED DESCRIPTION OF A PREFERRED EMBODIMENT

Figure 1:
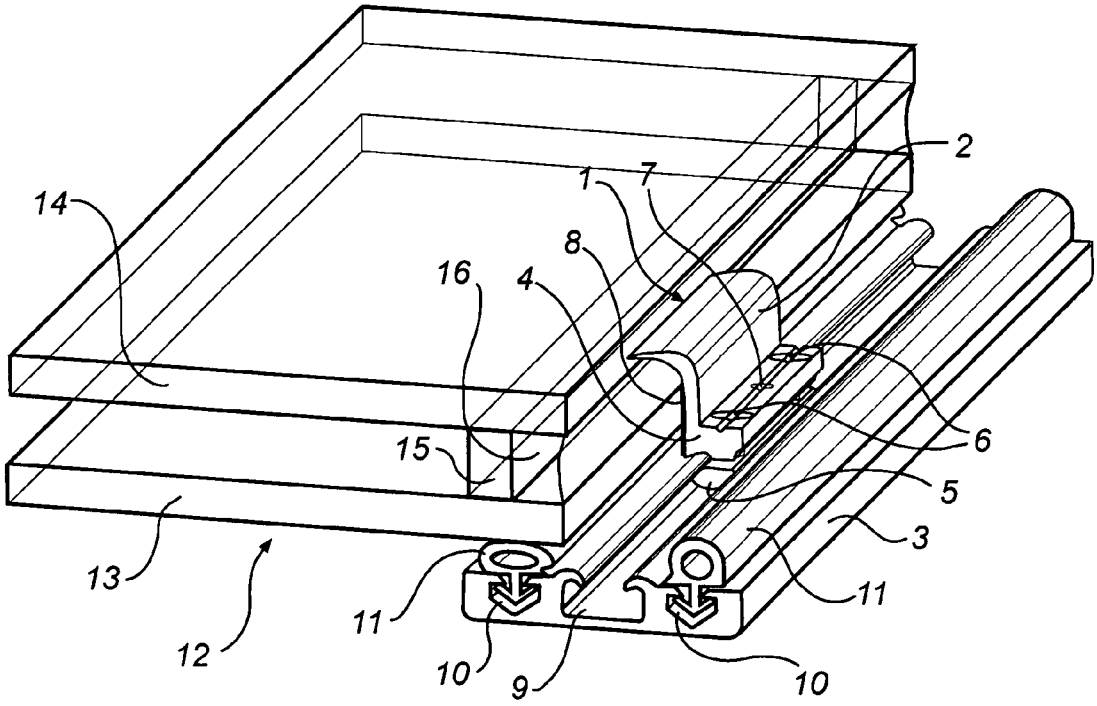
FIG. 1 is a perspective view of a device in accordance with the invention, the device being shown in its mounted position.

FIG. 1 shows a presently preferred embodiment of a device in accordance with the invention. The device 1 comprises an anchoring member 2 and a retainer member 3, said members preferably being made from profile sections of aluminium. In accordance with this embodiment, the anchoring member 2 consists of a swan part 4 (the configuration of the profiled section) and one grooved part 5, said parts being interconnected by a screw bond 6. The swan part 4 also is formed with a through-hole 7, into which a tool may be introduced to tilt the anchoring member 2 from said first position to said second position, and it is fitted with a moulding of silicone 8 on the face of the swan part 4 that is located underneath the head of the "swan". The retainer member 3 is also formed with an undercut groove 9, in which the grooved part 5 of the anchoring member 2 may travel. The retainer member is formed with two additional grooves 10 running in parallel with the first-mentioned groove 9. Also these additional grooves 10 are undercut and fitted with silicone mouldings 11. The purpose of the silicone mouldings 11 is to present a soft surface of contact between the retainer member 3 and the inner glass slab 13 of the insulating-glass sheet 12. FIG. 1 shows the device in conjunction with an insulating-glass sheet 12 comprising two glass slabs 13, 14. Sandwiched between the inner glass slab 13 and the outer glass slab 14 is a moulding 15 spaced a small distance from the edges of the glass slabs 13, 14. Exteriorly of this moulding 15 a jointing substance 16 is arranged, into the mass of which substance 16 the pointed portion of said swan part 4 is embedded. The screw bond 6 forces the grooved part 5 and the swan part 4 against one another and in this manner it locks the anchoring member relative to the retainer member because of the squeezing force exerted by these parts 4 and 5 on those portions of the groove 9 in the retainer member 3 that are closest to the opening.

Figure 2A:
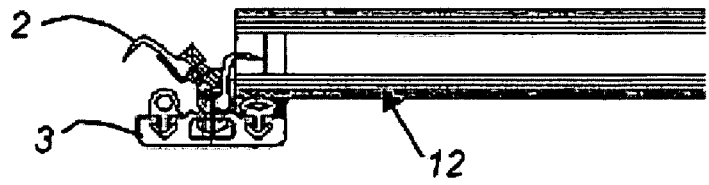
FIGS. 2*a*-2*i* show the sequence of attaching a sheet of insulating glass by means of a device in accordance with the present invention.
Figure 2B:
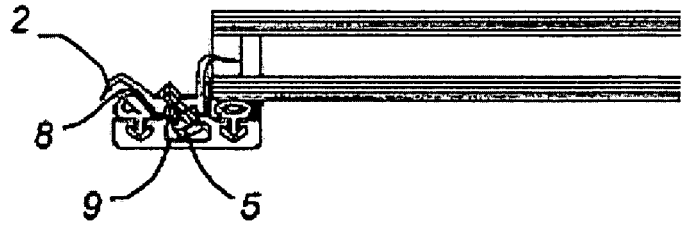
Figure 2C:
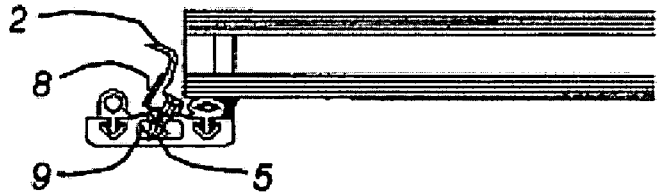

In accordance with a preferred embodiment of the invention the retainer member 3 is formed with means (not shown) allowing it to be attached to the weight-supporting structure, i.e. the structure supporting the entire glass wall cladding. FIG. 2*a* shows a retainer member 3, in which is arranged an anchoring member 2, which holds an insulating-glass sheet 12 in place. Before the next insulating-glass sheet 12 is to be fitted (in addition to the one already mounted), an additional anchoring member 2 must first be fitted in the retainer member 3. These anchoring members 2 may be slid into the groove or alternatively be forced into the groove in the manner shown in FIGS. 2*b* and 2*c*. The configuration of the grooved part 5 of the anchoring member 2 is such that it is formed with an edge arranged to be forced into the groove 9 when the anchoring member 2 is moved into a forwards inclined position. The anchoring member 2 is then tilted backwards and in this manner it may be fitted into the groove 9. In accordance with a preferred embodiment, the anchoring member 2 and the silicone moulding 8 are configured to ensure that a force of a predetermined magnitude must be applied in order to tilt the anchoring member 2 into the groove 9. The condition is that the moulding 8 is resilient because it is the inherent resistance of the moulding 8, when compressed, that must be overcome in order that the anchoring member may be tilted into the groove 9.

Figure 2D:
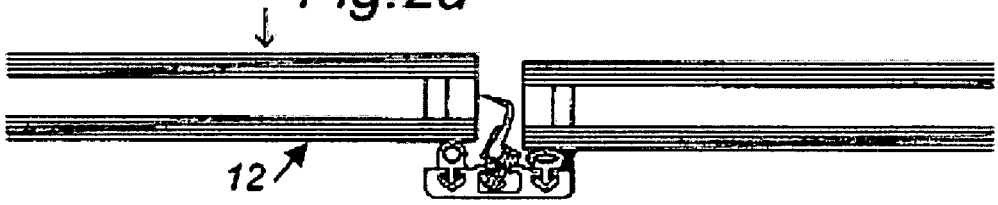
Figure 2E:
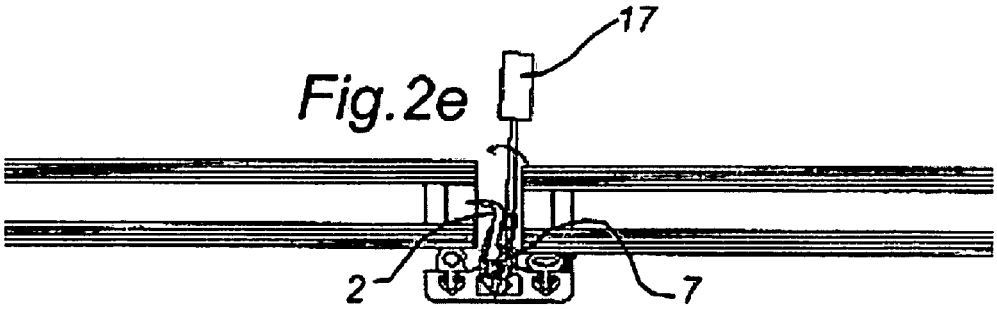
Figure 2F:
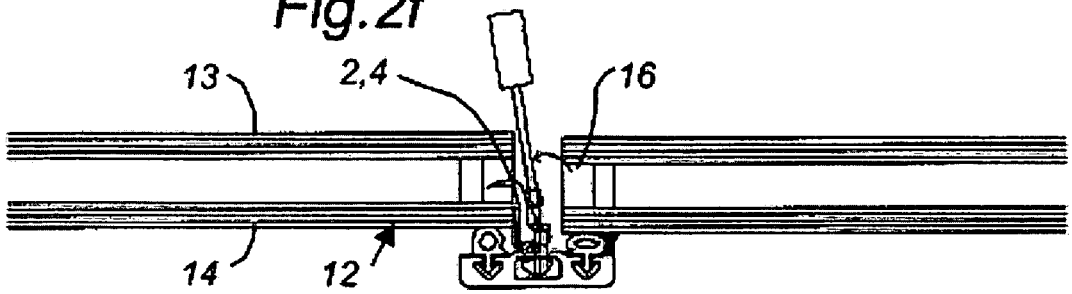
Figure 2G:
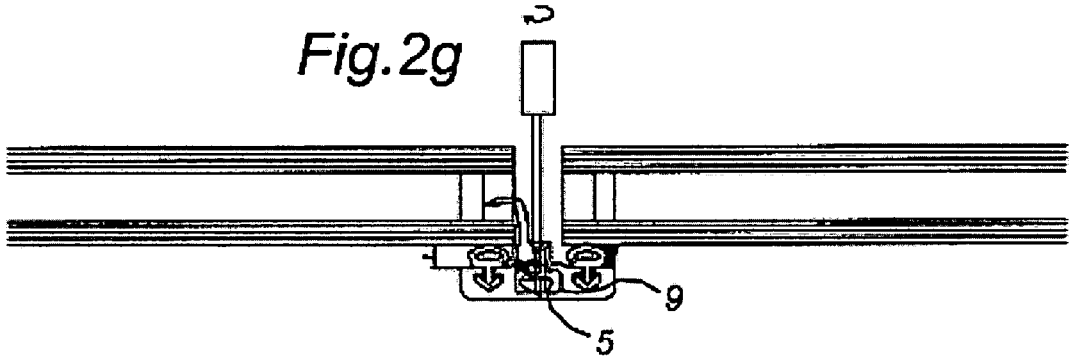
Figure 2H:
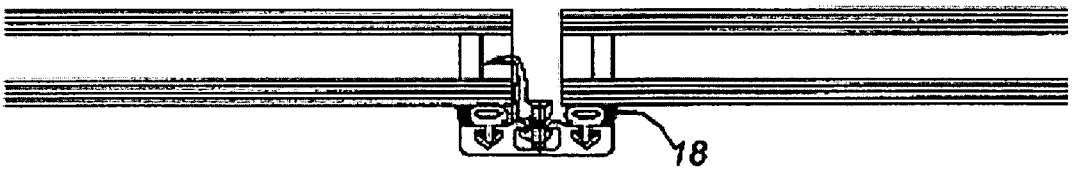
Figure 2I:
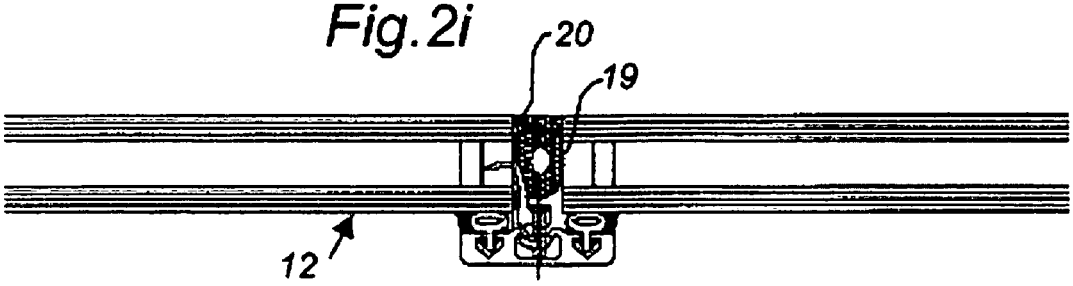

FIG. 2*d* shows the manner in which the insulating-glass sheet 12 is put in position and FIG. 2*e* shows a tool 17, such as a screwdriver, being introduced into the hole 7 in the anchoring member 2 and FIG. 2*f*, finally, shows the anchoring member 2 having been tilted against the insulating-glass sheet 12 such that the head of the swan part 4 is pressed into the jointing substance 16 between the glass slabs 13, 14. The swan part 4 and the grooved part 5 thereafter screwed together, see FIG. 2*g*, such that they eventually are immobilised relative to the opening of the groove 9. Internally, a sealing layer 18 and a supplementary fastening means, see FIG. 2*h*, preferably of silicone, are applied. Finally, a bottom moulding 19 is arranged in the gap between the insulating-glass sheets 12, and externally of the moulding 19 is applied an external weather-moulding 20, see FIG. 2*i*, which also preferably is made from silicone.

Figure 3A:
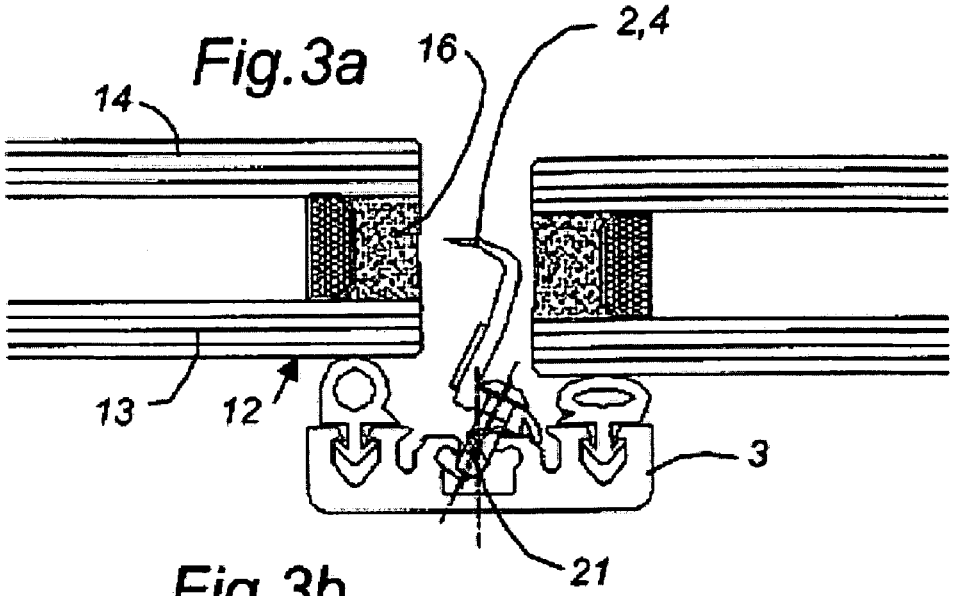
FIGS. 3*a*-3*c* show the sequence of attaching a sheet of insulating glass by means of a device in accordance with an alternative embodiment of the present invention.
Figure 3B:
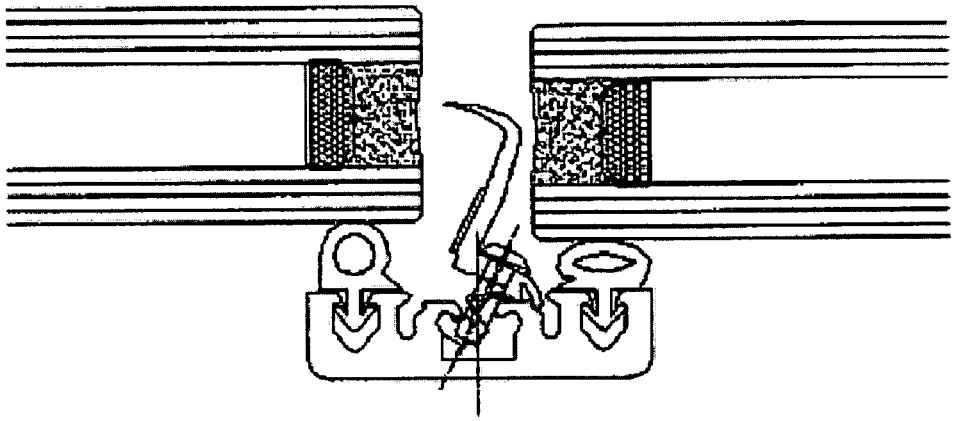
Figure 3C:
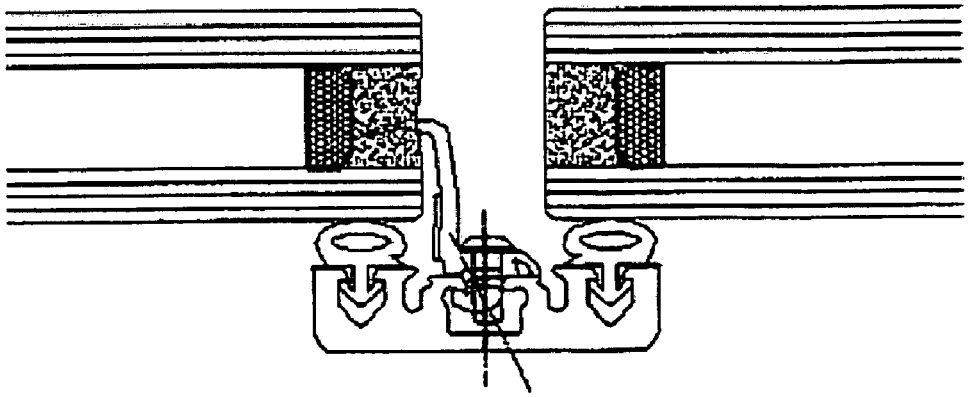

FIGS. 3*a*-3*c* show the mounting of an insulating-glass sheet 12 with the aid of an alternative device according to the present invention. Among other things, the swan part 4 together with a bellows element 21 forms the anchoring member 2. When the head of the swan part 4 has been tilted into the jointing substance 16 between the glass slabs 13, 14, the bellows element 21 is compressed for example by means of a screw, and in the same manner as in the previous embodiment it securely attaches the anchoring member 2 in the retainer member 3.

As will be appreciated, several modifications of the above-described embodiments of the invention are possible within the scope of the appended claims. For example, as described above the anchoring member 2 may be connected to the retainer member 3 in some other way than via a groove 9, such as for example by means of a hinge arrangement. Furthermore, it is likewise possible to fit the retainer member 3 with a spring-loaded means, which is arranged to snap into a recess of complementary configuration formed in the anchoring member 2 to secure the position of the anchoring member 2.

The invention claimed is:

1. A device in glass wall claddings for mounting insulating-glass sheets, each glass sheet having at least two glass slabs which are joined together by a jointing substance, said device comprising:

a retainer member; and an anchoring member, wherein said retainer member has an articulated connection to said anchoring member, one of said retainer member and said anchoring member is insertable into the other such that said anchoring member is rotatable from a first position of rest to a second position, in said first position, said device, upon mounting of said insulating-glass sheet, allows the insulating-glass sheet to be placed in a desired position, and in said second position, upon mounting of said insulating-glass sheet, said device grips at least one glass slab of said insulating-glass sheet, wherein a portion of the anchoring member penetrates into said jointing substance of an insulating-glass sheet as the anchoring member of the device is guided from said first position to said second position, in response to the anchoring member being tilted to said second position.

2. A device as claimed in claim 1, wherein said anchoring member comprises a second part arranged to travel in a groove formed in said retainer member.

3. A device as claimed in claim 2, wherein said second part of the anchoring member, is joined to said first part by an interconnection device.

4. A device as claimed in claim 3, wherein said interconnection device is arranged to lock the device in said second position.

5. A device as claimed in claim 2, wherein said groove is undercut and wherein said anchoring member is arranged for tilting movement about an axis adjacent and along the opening of said groove.

6. A device as claimed in claim 1, wherein said anchoring member part, which upon displacement of said device from the first position to the second position, penetrates into said jointing substance, has a length along the lateral edge of the insulating-glass sheet that exceeds the spacing between two juxtaposed insulating-glass sheets.

7. A device as claimed in claim 1, wherein said anchoring member is formed with protruding and a spring-biased device, said device, upon movement of said anchoring member from said first position to said second position, fitting in said second position into recesses of complementary configuration formed on the retainer member.

8. A device as claimed in claim 1, wherein said retainer member is provided with resilient mouldings arranged to abut against the insulating-glass sheets.

9. A device as claimed in claim 1, wherein said anchoring member comprises a resilient portion on the face of the anchoring member that in use is turned towards the edge of the glass slab for abutment of said portion against said edge.

10. A device according to claim 1, wherein said anchoring member is separable from said retainer member.

11. A device according to claim 1, wherein said articulated connection is a hinged connection.

12. A device according to claim 1, wherein said anchoring member is rotatable from a first position of rest to a second position of rest.

13. A device according to claim 12, wherein said anchoring member is separable from said retainer member.

14. A device according to claim 12, wherein said articulated connection is a hinged connection.

15. A device according to claim 12, wherein said anchoring member is rotatable from a first unbiased position to a second unbiased position.

16. A device in glass wall claddings for mounting insulating-glass sheets, each glass sheet having at least two glass slabs which are joined together by a jointing substance, said device comprising:

a retainer member; and an anchoring member, wherein said retainer member has an articulated connection to said anchoring member, one of said retainer member and said anchoring member is insertable into the other such that said anchoring member is rotatable from a first unbiased position to a second position, in said first position, said device, upon mounting of said insulating-glass sheet, allows the insulating-glass sheet to be placed in a desired position, and in said second position, upon mounting of said insulating-glass sheet, said device grips at least one glass slab of said insulating-glass sheet, wherein a portion of the anchoring member penetrates into said jointing substance of an insulating-glass sheet as the anchoring member of the device is guided from said first position to said second position, in response to the anchoring member being tilted to said second position.

17. A device in glass wall claddings for mounting insulating-glass sheets, each glass sheet having at least two glass slabs which are joined together by a jointing substance, said device comprising:

a retainer member; and an anchoring member, wherein said retainer member has an articulated connection to said anchoring member, one of said retainer member and said anchoring member is insertable into the other such that said anchoring member is rotatable from a first position to a second position, in said first position, said device allows the insulating-glass sheet to be placed in a desired position, and in said second position, upon mounting of said insulating-glass sheet, said device grips at least one glass slab of said insulating-glass sheet, wherein a portion of the anchoring member penetrates into said jointing substance of an insulating-glass sheet as the anchoring member of the device is guided from said first position to said second position.

* * * * *